US012398562B2

(12) United States Patent
Hayek et al.

(10) Patent No.: US 12,398,562 B2
(45) Date of Patent: Aug. 26, 2025

(54) CONCRETE POST-TENSIONING ANCHORS

(71) Applicant: CCL STRESSING INTERNATIONAL LTD, Leeds (GB)

(72) Inventors: Carol Hayek, Jessup, MD (US); Richard Mouzannar, Zouk Mosbeh (LB)

(73) Assignee: CCL STRESSING INTERNATIONAL LTD, Leeds (GB)

( * ) Notice: Subject to any disclaimer, the term of this patent is extended or adjusted under 35 U.S.C. 154(b) by 423 days.

(21) Appl. No.: 18/016,565

(22) PCT Filed: Jun. 4, 2021

(86) PCT No.: PCT/IB2021/054937
§ 371 (c)(1),
(2) Date: Jan. 17, 2023

(87) PCT Pub. No.: WO2022/013638
PCT Pub. Date: Jan. 20, 2022

(65) Prior Publication Data

US 2023/0295926 A1 Sep. 21, 2023

Related U.S. Application Data

(60) Provisional application No. 63/052,283, filed on Jul. 15, 2020.

(51) Int. Cl.
*E04C 5/12* (2006.01)

(52) U.S. Cl.
CPC ..... *E04C 5/122* (2013.01); *E04C 5/125* (2013.01)

(58) Field of Classification Search
CPC ..... E04C 5/12; E04C 5/122; E04C 5/125
See application file for complete search history.

(56) References Cited

U.S. PATENT DOCUMENTS

| | | | | |
|---|---|---|---|---|
| 5,345,742 | A * | 9/1994 | Rogowsky | E04C 5/12 52/223.13 |
| 6,027,278 | A * | 2/2000 | Sorkin | E04C 5/122 403/374.1 |
| 6,748,708 | B1 * | 6/2004 | Fuzier | E01D 19/16 52/223.13 |
| 9,926,698 | B2 * | 3/2018 | Sorkin | E04C 5/12 |
| 10,458,063 | B2 * | 10/2019 | Yamazaki | E04C 5/12 |

(Continued)

FOREIGN PATENT DOCUMENTS

EP 2365154 A1 9/2011

OTHER PUBLICATIONS

International Search Report and Written Opinion dated Sep. 8, 2021 in corresponding International Application No. PCT/IB2021/054937, 10 pages.

(Continued)

*Primary Examiner* — Paola Agudelo
(74) *Attorney, Agent, or Firm* — MH2 Technology Law Group LLP

(57) ABSTRACT

A post-tensioning anchor is configured to post-tension at least one tension steel element. The post-tensioning anchor includes a force transfer unit configured to transmit pre-stressing force into a surrounding concrete substrate and at least one steel member configured to resist an anchoring force by the at least one tension steel element on the force transfer unit. The force transfer unit is made of concrete.

20 Claims, 13 Drawing Sheets

(56) References Cited

U.S. PATENT DOCUMENTS

| | | | | |
|---|---|---|---|---|
| 10,787,813 | B2 * | 9/2020 | Mikulsky | E04C 5/122 |
| 2006/0117683 | A1 * | 6/2006 | Hayes | E04C 5/127<br>52/223.13 |
| 2016/0069080 | A1 * | 3/2016 | Palermo | E04C 1/40<br>52/223.6 |
| 2016/0168855 | A1 * | 6/2016 | Brand | E01D 19/14<br>52/223.13 |
| 2019/0194884 | A1 * | 6/2019 | Annan | E01D 19/16 |
| 2020/0157818 | A1 * | 5/2020 | Erdogan | E04C 5/122 |
| 2021/0254340 | A1 * | 8/2021 | Winistörfer | E04C 5/127 |
| 2021/0381239 | A1 * | 12/2021 | Langston | E04C 5/125 |
| 2023/0295926 | A1 * | 9/2023 | Hayek | E04C 5/122<br>52/223.13 |

OTHER PUBLICATIONS

Chatel, C. (Authorized officer), International Preliminary Report on Patentability in corresponding International Application No. PCT/IB2021/054937 mailed on Jan. 26, 2023, 9 pages.

Examination Report in corresponding Saudi Arabian Application No. 523442163 mailed on Sep. 28, 2023, 11 pages, with English translation.

Examination Report in corresponding Saudi Arabian Application No. 523442163 mailed on Apr. 23, 2024, 6 pages, with English translation.

* cited by examiner

CONCRETE POST-TENSIONING ANCHORS

CROSS-REFERENCE TO RELATED APPLICATIONS

This application is a U.S. National Stage application of PCT/IB2021/054937 filed on Jun. 4, 2021, which claims priority to U.S. Provisional Application No. 63/052,283 filed on Jul. 15, 2020, the entire disclosures of which are hereby incorporated by reference in their entireties.

BACKGROUND

The present disclosure relates generally to post-tensioning anchors and, more particularly, to post-tensioning anchors made from concrete.

Prestressed concrete is a form of concrete used in construction, where the concrete is prestressed (compressed) during production such that the concrete is strengthened against tensile forces or stresses that will exist when the concrete is in use. The prestressing is produced by the tensioning of high-strength tension elements located within or adjacent to the concrete. Prestressed concrete has the characteristics of high-strength concrete when subject to any subsequent compression forces and of ductile high-strength steel when subject to tension forces. Thus, prestressed concrete has improved structural capacity and/or serviceability compared with conventionally reinforced concrete.

Post-tensioning is one type of prestressing where high-strength tension elements (e.g., steel cable) are placed before or after the concrete is cast. Then, after the concrete is cast and has gained strength, but typically before service loads are applied, the tension elements are pulled tight (i.e., tensioned) and anchored against the edges of the concrete (e.g, an outer edge or an edge in the middle of a slab). Post-tensioning may be carried out via monostrand systems, where each tension element is placed and stressed individually, or via multi-strand systems, where several tension elements are placed in a single conduit and where stressing can be done individually or simultaneously for the group.

In various types of construction applications (e.g., bridges, buildings, transfer beams, containment structures, other structural applications, other geotechnical foundations, and other civil applications), highly stressed tension elements are used in prestressed concrete construction or post-tensioned concrete construction or geotechnical engineering. The high tensile forces concentrated in the corresponding tension elements need to be dissipated by anchoring in the surrounding concrete substrate (e.g., prestressed concrete) structure or the ground.

Some conventional post-tensioning anchors are made from steel and/or iron casting. For example, some conventional multi-piece anchors for multistrand systems include a force transfer unit (or anchorage transfer guide) and at least one anchor head (or anchor block or wedge plate). The force transfer unit and the anchor head are made from steel and/or iron casting. Some conventional one-piece anchors, typically used for monostrand systems, include a force transfer unit that is made of steel or iron casting. In such conventional systems, the anchors need to be coated or encased with a corrosion resistant material to protect the anchors from corrosion.

FIGS. 16 and 17 illustrate conventional two-piece post-tensioning anchors 600, 700 for multistrand systems. The anchors 600, 700 include a force transfer unit 602, 702 and an anchor head 604, 704. Tension elements (not shown) that extend through the force transfer unit 602, 702 and the anchor head 604, 704 are locked in place by wedges (not shown) that are received by the openings in the anchor head 604, 704. The force transfer unit 602, 702 and the anchor head 604, 704 are made of steel or iron casting. FIG. 18 illustrates a conventional anchor 800 for a monostrand system. The anchor 800 includes a force transfer unit 802 and an extruder 804. A tension element (not shown) that extends through the extruder 804 and the force transfer unit 802 is locked in place by a wedge (not shown) that is received by the opening in the force transfer unit 802. The force transfer unit 802 is made of steel or iron casting.

It may be desirable to provide post-tensioning anchors and/or force transfer units for post-tensioning anchors that do not need to be coated or encased with a corrosion resistant material. More particularly, it may be desirable to provide post-tensioning anchors and/or force transfer units made from concrete. For example, it may be desirable to provide one-piece concrete anchors for monostrand and multistrand, bonded and unbonded systems. For example, it may be desirable to provide multi-piece anchors including a force transfer unit made from concrete and at least one anchor head made from steel or iron casting. For example, it may be desirable to provide one-piece or multi-piece concrete anchors with at least one steel member embedded in the anchor or close to the face of the anchor. It may also be desirable to provide post-tensioning anchor assemblies with reinforcement and without reinforcement in a concrete substrate at the anchor location.

SUMMARY

In accordance with various embodiments of the disclosure, a post-tensioning anchor is configured to post-tension at least one tension steel element that includes a plurality of steel wires. The post-tensioning anchor includes a force transfer unit configured to transmit prestressing force into a surrounding concrete substrate and at least one steel member configured to resist a force by the tension steel element on the force transfer unit.

In some aspects, the force transfer unit is made of high strength concrete, for example, high performance concrete or ultra-high-performance concrete.

According to various aspects, the force transfer unit is made of a concrete that contains organic, basalt, bare steel, stainless steel, or coated steel fibers.

According to some aspects, the force transfer unit has a first end and an opposite second end, and the first end being configured to receive at least one duct or connection piece or fitting and at least one tension steel element.

In some aspects, the at least one steel member is embedded in the force transfer unit at the second end. In various aspects, the steel member is a steel barrel, or a steel channel, while in other aspects, the steel member is a continuous steel spiral or a series of steel links. In some aspects, the steel members may include a combination of steel members placed anywhere along the force transfer unit, for example, embedded in or located outside the force transfer unit.

According to various aspects, the force transfer unit is configured to receive a plurality of tension steel elements, and the second end of the force transfer unit includes one bore or a number of bores corresponding to or greater than a number of the plurality of tension steel elements.

In various aspects, the at least one steel member is at least one anchor head disposed at the second end of the force transfer unit. In some aspects, the force transfer unit does not include a reinforcement member.

According to some aspects, the force transfer unit is configured to receive a plurality of tension steel elements, and the anchor head includes a number of bores corresponding to or greater than the number of the plurality of tension steel elements.

According to some aspects, the force transfer unit is configured to receive a plurality of tension steel elements, and a plurality of individual anchor heads corresponding to the number of the plurality of tension steel elements.

In some aspects, the concrete is high strength concrete having a compressive strength of at least 10,000 psi at 28 days, and preferably 15,000 to 50,000 psi at 28 days. According to various aspects, the high strength concrete has a tensile strength of greater than 400 psi.

In various aspects, the concrete can be any structural concrete including, but not limited to, conventional concrete, fiber reinforced concrete, self-compacting concrete, shrinkage-reducing concrete, or any combination thereof.

According to various aspects, an anchoring assembly includes one of the aforementioned post-tensioning anchors, at least one duct or connection fitting configured to receive the at least one tension steel element and being received by the post-tensioning anchor, and at least one clamping wedge configured to cooperate with the post-tensioning anchor to clamp the at least one tension steel element.

In various aspects, one of the aforementioned post-tensioning anchors is used in a construction application or a structural application including a concrete substrate with reinforcement surrounding the anchor in the concrete substrate.

According to some aspects, one of the aforementioned post-tensioning anchors is used in a construction application or a structural application including a concrete substrate without reinforcement surrounding the anchor in the concrete substrate.

In various aspects, the concrete anchors can take any shape such as circular, rectangular, oblong, multi-plane, or any combination thereof.

BRIEF DESCRIPTION OF THE DRAWINGS

Embodiments of the invention will now be further described, by way of example only, and with reference to the accompanying drawings, in which.

DETAILED DESCRIPTION OF EMBODIMENTS

Figure 1:
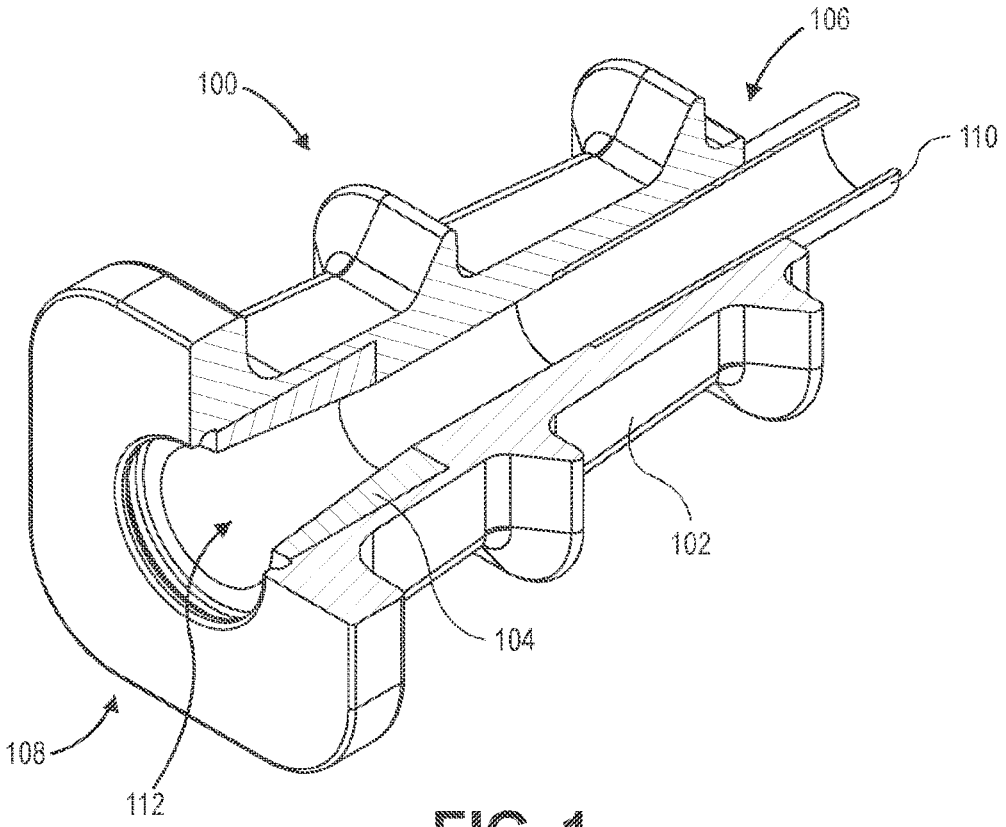
FIG. 1 is a perspective, partial cross-sectional view of an exemplary one-piece monostrand post-tensioning anchor in accordance with various aspects of the disclosure.
Figure 2A:
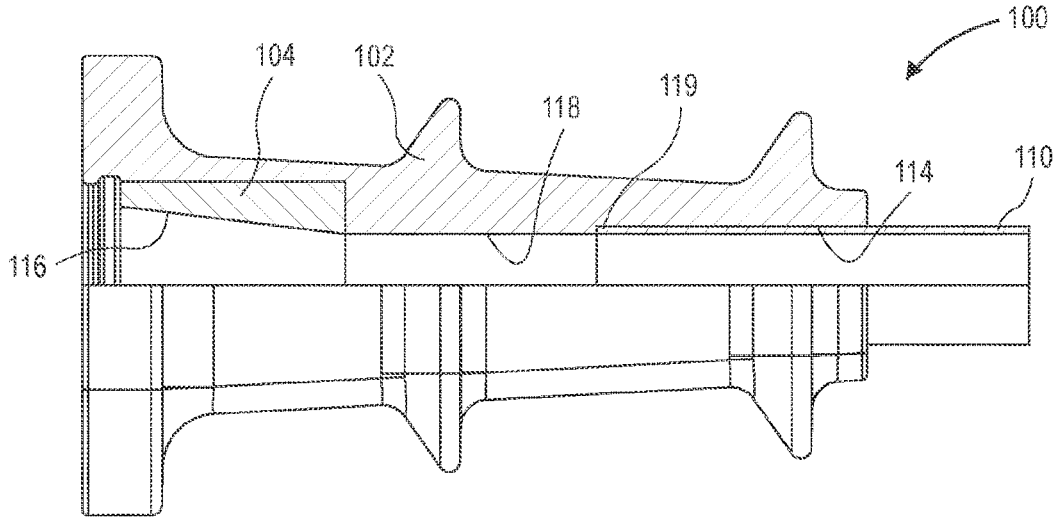
FIG. 2A is a side, partial cross-sectional view of the post-tensioning anchor of FIG. 1.

FIGS. 1 and 2A illustrate an exemplary one-piece monostrand post-tensioning anchor 100 in accordance with various aspects of the disclosure. The anchor 100 includes a force transfer unit 102 and at least one steel member 104, for example, a steel barrel. It some aspects, the steel member 104 is embedded. The force transfer unit 102 has a first end 106 and an opposite second end 108. The first end 106 is configured to receive a duct or connection fitting 110, for example, an adaptor piece, a thin plastic sleeve, a sheet metal pipe, a steel duct, or a plastic duct. The connecting fitting 110 can be provided with the anchor 100 or installed at a later time. The barrel 104 is proximate the second end 108.

The anchor 100 defines a through bore 112 having a first end bore portion 114, a second end bore portion 116, and a middle bore portion 118 between the first end bore portion 114 and the second end bore portion 116. The first end bore portion 114 has an inner diameter that is greater than an inner diameter of the middle bore portion 118 such that a radially-extending wall 119 connects the first end bore portion 114 and the middle bore portion 118. The radially-extending wall 119 faces toward the first end 106 of the force transfer unit 102. The second end bore portion 116 has an inner diameter that tapers in a direction from the second end 108 of the force transfer unit toward the first end 106.

It should be appreciated that in some embodiments, the first end bore portion 114 and the middle bore portion 118 conduit 110 may have the same diameter, thus eliminating the radially-extending wall 119. In such an embodiment, the connection fitting 110 may extend all the way to the steel member 104. In some embodiments, the conduit 110 may be omitted such that a duct abuts the first end 106 of the force transfer unit 102 (see, e.g., FIG. 6B). In some embodiments, the connection fitting 110 may be eliminated, and tape (not shown) can instead be applied to a tension steel element that extends through the force transfer unit 102.

Figure 2B:
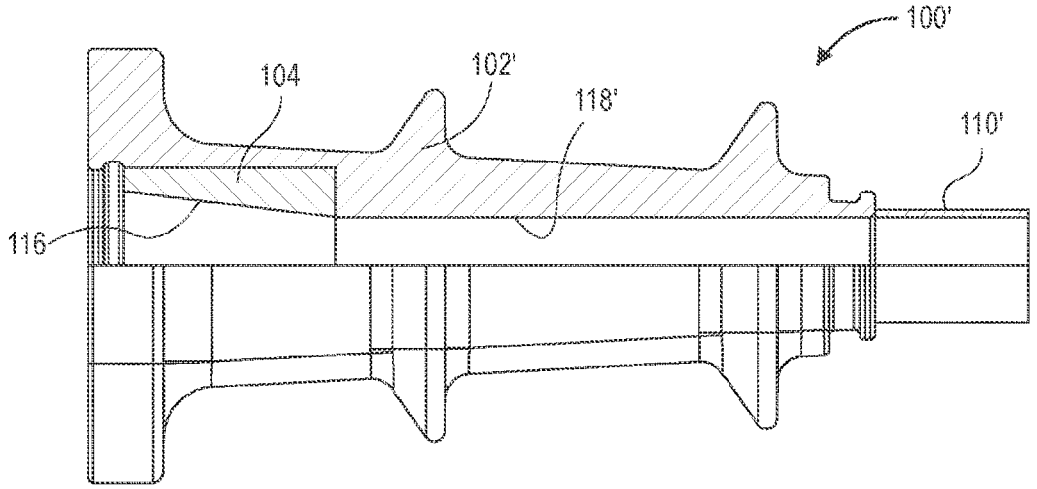
FIG. 2B is a side, partial cross-sectional view of an exemplary one-piece monostrand post-tensioning anchor in accordance with various aspects of the disclosure.

Another exemplary one-piece monostrand post-tensioning anchor 100' similar to anchor 100 is shown in FIG. 2B. The anchor 100' may include a main bore portion 118' that extends from the end bore portion 116 to the first end 106 of the force transfer unit, and a duct or connection fitting 110' may be configured to be disposed outside of the force transfer unit 102' without entering the main bore portion 118'.

The force transfer unit 102 is made of any structural concrete including, but not limited to, conventional concrete, fiber reinforced concrete, self-compacting concrete, shrinkage-reducing concrete, or any combination thereof. In some embodiments, the concrete is high strength concrete such as, but not limited to, high-performance concrete (HPC) or ultra-high-performance concrete (UHPC). High strength concrete has a compressive strength three to ten times or higher that of conventional concrete. Compressive strength is the ability of a material to resist a compression load. Conventional concrete used in structural applications typically has a compressive strength of 3,000 to 8,000 psi at 28 days, or 4,000 to 6,000 psi at 28 days. High strength concrete has a compressive strength of 10,000 to 50,000 psi or higher at 28 days. Another measure of strength is tensile strength or tension, which is how strong a material is when you pull it. While conventional concrete has a tensile strength of 100 to 400 psi, high strength concrete has a tensile strength of greater than 400 psi.

UHPC also includes durability properties of freeze/thaw resistance, chloride resistance (like in road salts), and abrasion resistance that are similar to hard rock. Freeze/thaw resistance is tested by subjecting concrete prisms to freezing and thawing while submerged in a water bath. UHPC exhibited low degradation reaching 100% of its material properties after 600 freeze/thaw cycles. In one aspect, chloride permeability is measured by ponding a 3-percent sodium chloride solution on the surface of the concrete for 90 days. After 90 days, the level of migration of chloride ions into the concrete is determined. UHPC showed extremely low chloride migration when tested, less than 10% the permeability of conventional concrete. In one aspect, abrasion resistance is determined by measuring the amount of concrete abraded off a surface by a rotating cutter in a given time period. UHPC demonstrates excellent abrasion resistance, nearly twice as resistant as conventional concrete. Thus, UHPC provides superior corrosion resistance in comparison with conventional concrete, therefore eliminating the need for coating to provide corrosion protection.

The ingredients of UHPC are mainly: cement, silica fume, fine quartz, sand, high-range water reducer, water, and fibers such as bare steel fibers, stainless steel fibers, coated steel fibers, polymer fibers, or organic fibers. In some aspects, steel fiber content is between 100 per cubic yard (pcy) and 500 pcy, or in some aspects 130 pcy to 350 pcy, or in some aspects larger than 400 pcy.

Figure 3:
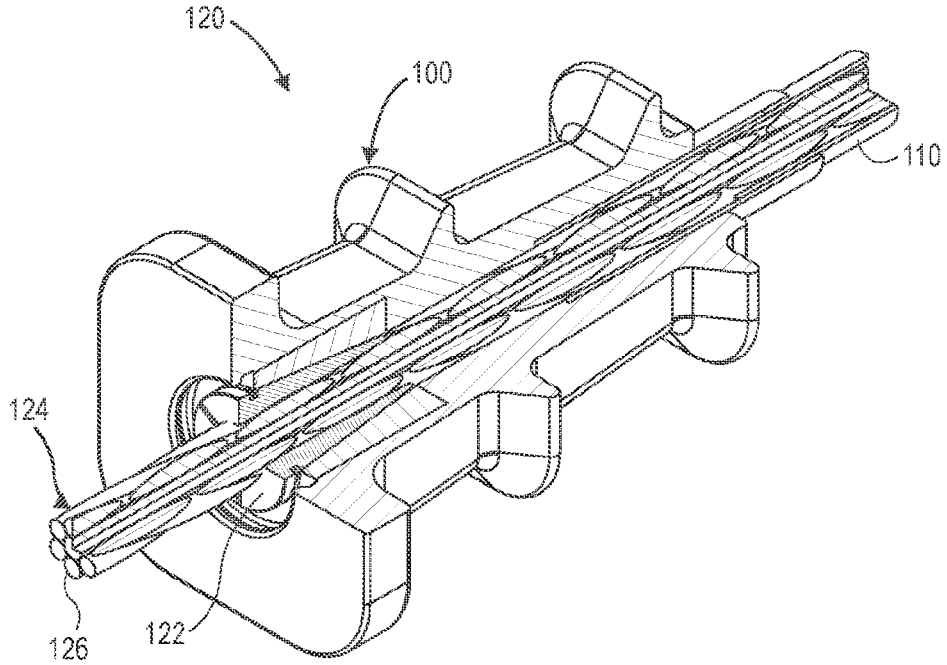
FIG. 3 is a perspective, partial cross-sectional view of an exemplary anchoring assembly including the post-tensioning anchor of FIG. 1.
Figure 4:
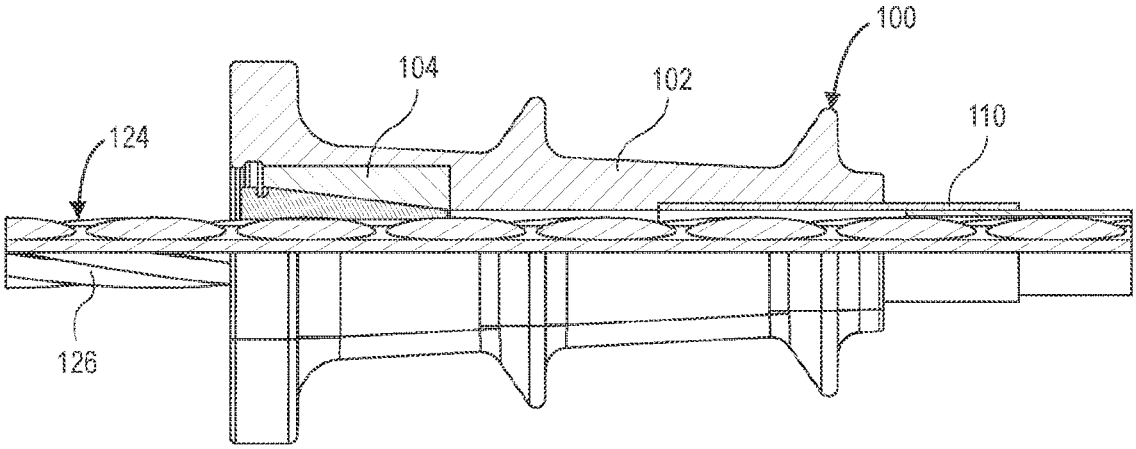
FIG. 4 is a side, partial cross-sectional view of the exemplary anchoring assembly of FIG. 3.

Referring now to FIGS. 3 and 4, an exemplary anchoring assembly 120 including the post-tensioning anchor 100 is illustrated and described. The assembly 120 includes the anchor 100, the connection fitting 110, and one or more wedge pieces 122, for example, clamping wedges. The connection fitting 110 is configured to encase a tension steel element 124, for example, a steel strand which may include a plurality of twisted steel wires 126. The tension steel element 124 may be coated with a protective coating. The prestressing tension steel element 124 can be manufactured as per the requirements of ASTM A-416 and/or ASTM A-779, or European Norm such as EN 10138, or equivalent international standards, and typical strand sizes include, but are not limited to, 0.50, 0.60, and 0.70 inch in diameter. A typical steel strand used for post-tensioning will have an ultimate strength of 270,000 psi, or between 270,000 psi and 320,000 psi.

As shown in FIGS. 3 and 4, the tension steel element 124 is fed through the through bore 112 in the anchor 100 from either end of the anchor 100. The first end 106 of the force transfer unit 102 is configured to receive the connection fitting or a conduit 110, and the radially-extending wall 119 is configured to limit a distance that the connection fitting 110 can be inserted into the through bore 112. Alternatively, the first end 106 of the force transfer unit 102 may include internal threads or any other conventional means for limiting the distance that the connection fitting 110 can be inserted into the through bore, and extending bore portion 118 to the first end 106. The second end 108 of the force transfer unit 102 is configured to receive the one or more wedge pieces 122, and the one or more wedge pieces 122 are configured to cooperate with the tapered second end bore portion 116 such that a tensile force of the tension steel element 124 is introduced into the one or more wedge pieces 122, which are pressed axially into the tapered second end bore portion 116 of the anchor 100 and introduce the tensile force via their outer surface into the anchor 100. The steel member 104 is configured to resist the force at the one or more wedge pieces 122. It should be appreciated that in some embodiments, the conduit 110 may extend all the way to the steel member 104, and in some embodiments, the conduit 110 may be omitted such that a duct will abut the first end 106 of the force transfer unit 102 (see, e.g., FIG. 6B).

Figure 5:
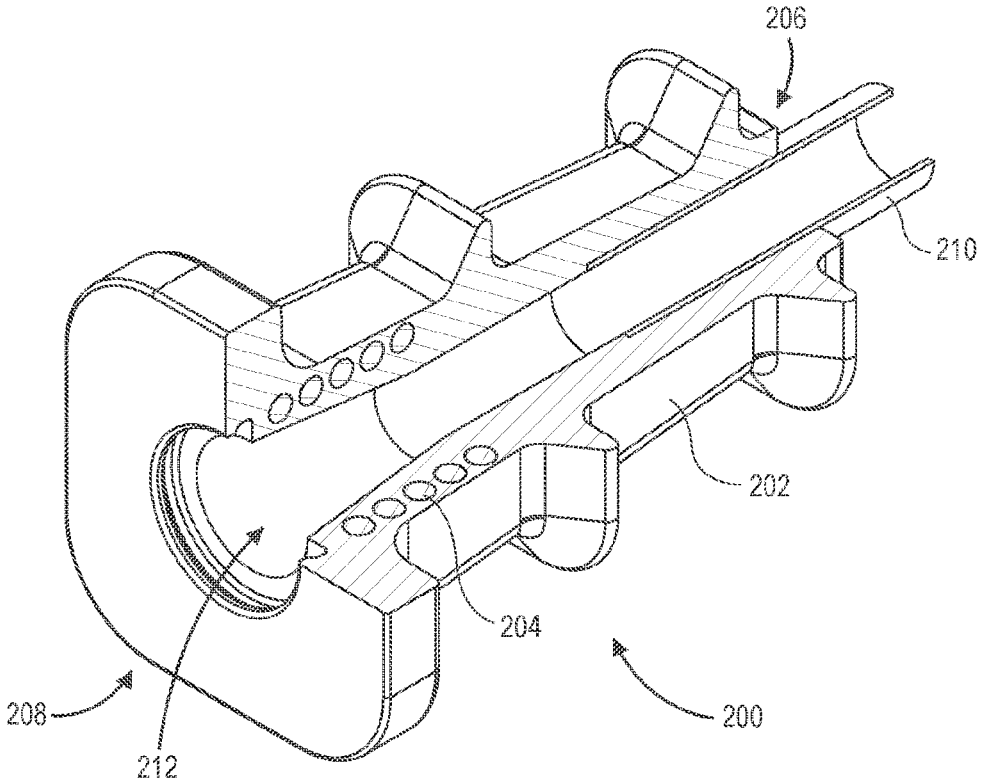
FIG. 5 is a perspective view of an exemplary one-piece monostrand post-tensioning anchor in accordance with various aspects of the disclosure.
Figure 6A:
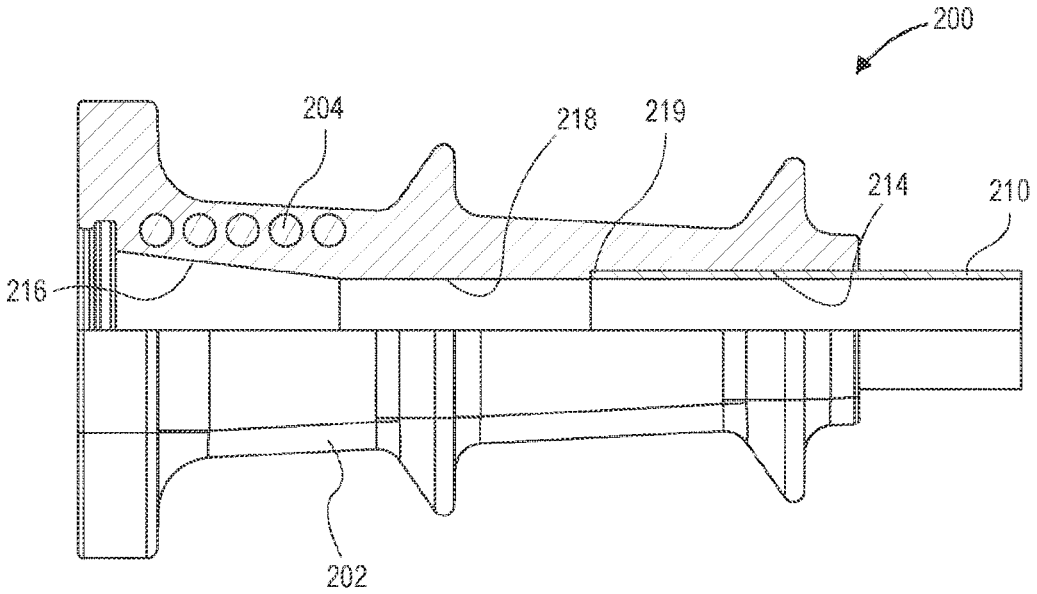
FIG. 6A is a side, partial cross-sectional view of the post-tensioning anchor of FIG. 5.

FIGS. 5 and 6A illustrate another exemplary one-piece monostrand post-tensioning anchor 200 in accordance with various aspects of the disclosure. The anchor 200 is similar to the anchor 100 described above, but includes some variations as described below. The anchor 200 includes a force transfer unit 202 and at least one steel member 204, for example, a steel spiral or a series of steel links. The force transfer unit 202 has a first end 206 and an opposite second end 208. The first end 206 is configured to receive a duct or a connection fitting 210, for example, an adaptor piece, a thin plastic sleeve, a sheet metal pipe, a steel duct, or a plastic duct. The steel member 204 is proximate the second end 208. The force transfer unit 202 is made of any structural concrete including, but not limited to, conventional concrete, fiber reinforced concrete, self-compacting concrete, shrinkage-reducing concrete, or any combination thereof. In some embodiments, the concrete is high strength concrete such as, but not limited to, HPC or UHPC.

The anchor 200 defines a through bore 212 having a first end bore portion 214, a second end bore portion 216, and a middle bore portion 218 between the first end bore portion 214 and the second end bore portion 216. The first end bore portion 214 has an inner diameter that is greater than an inner diameter of the middle bore portion 218 such that a radially-extending wall 219 connects the first end bore portion 214 and the middle bore portion 218. The radially-extending wall 219 faces toward the first end 206 of the force transfer unit 202. Alternatively, the first end 206 of the force transfer unit 202 may include internal threads or any other conventional means for limiting the distance that the connection fitting 210 can be inserted into the through bore, and extending bore portion 218 till the first end 206. The second end bore portion 216 has an inner diameter that tapers in a direction from the second end 208 of the force transfer unit toward the first end 206. It should be appreciated that in some embodiments, the connection fitting 210 may extend all the way to the end of the middle bore portion 218 adjacent the second end bore portion 216.

Figure 6B:
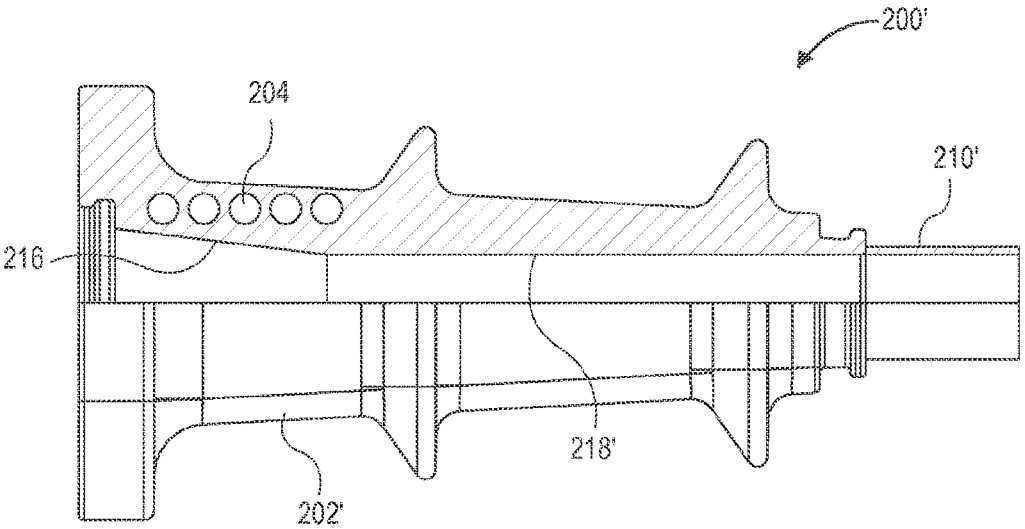
FIG. 6B is a side, partial cross-sectional view of an exemplary one-piece monostrand post-tensioning anchor in accordance with various aspects of the disclosure.

Another exemplary one-piece monostrand post-tensioning anchor 200' similar to anchor 200 is shown in FIG. 6B. The anchor 200' may include a main bore portion 218' that extends from the end bore portion 216 to the first end 206 of the force transfer unit, and a duct or connection fitting 210' may be configured to be disposed outside of the force transfer unit 202' without entering the main bore portion 218'.

Figure 7:
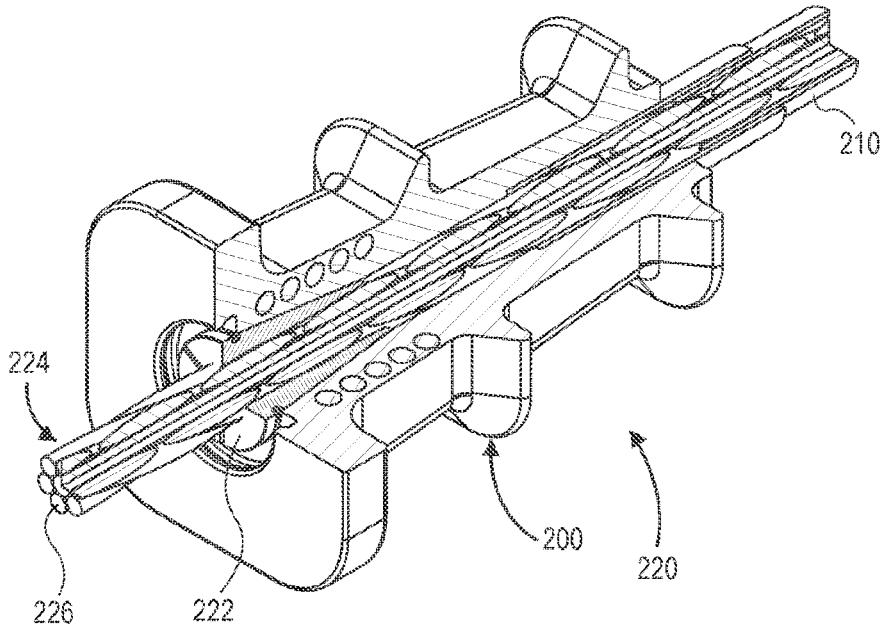
FIG. 7 is a perspective, partial cross-sectional view of an exemplary anchoring assembly including the post-tensioning anchor of FIG. 5.
Figure 8:
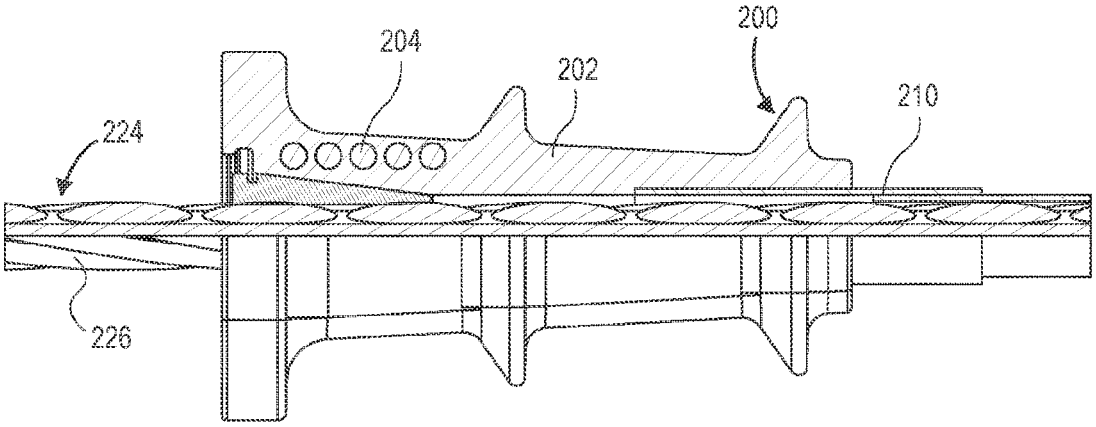
FIG. 8 is a side, partial cross-sectional view of the exemplary anchoring assembly of FIG. 7.

Referring now to FIGS. 7 and 8, an exemplary anchoring assembly 220 including the post-tensioning anchor 200 is illustrated and described. The assembly 220 includes the anchor 200, the connection fitting 210, and one or more wedge pieces 222, for example, clamping wedges. The connection fitting 210 is configured to encase a steel tension element 224, for example, a steel strand, which may include a plurality of twisted steel wires 226. The steel tension element 224 may be coated with a protective coating. The prestressing steel tension element 224 can be manufactured as per the requirements of ASTM A-416 and ASTM A-779, or equivalent international standards, and typical strand sizes include, but are not limited to, 0.50, 0.60, and 0.70 inch in diameter. A typical steel strand used for post-tensioning will have an ultimate strength of 270,000 psi or between 270,000 psi and 320,000 psi.

As shown in FIGS. 7 and 8, the tension steel element 224 is fed through the through bore 212 in the anchor 200 from either end of the anchor 200. The first end 206 of the force transfer unit 202 is configured to receive the connection fitting 210, and the radially-extending wall 219 is configured to limit a distance that the connection fitting 210 can be inserted into the through bore 212. Alternatively, the first end 206 of the force transfer unit 202 may include internal threads or any other conventional means for limiting the distance that the connection fitting 210 can be inserted into the through bore and extending bore portion 218 to the first end 206. The second end 208 of the force transfer unit 202 is configured to receive the one or more wedge pieces 222, and the one or more wedge pieces 222 are configured to cooperate with the tapered second end bore portion 216 such that a tensile force of the tension steel element 224 is introduced into the one or more wedge pieces 222, which are pressed axially into the tapered second end bore portion 216 of the anchor 200 and introduce the tensile force via their outer surface into the anchor 200. The steel member 204 is configured to resist the force at the one or more wedge pieces 222.

Figure 9:
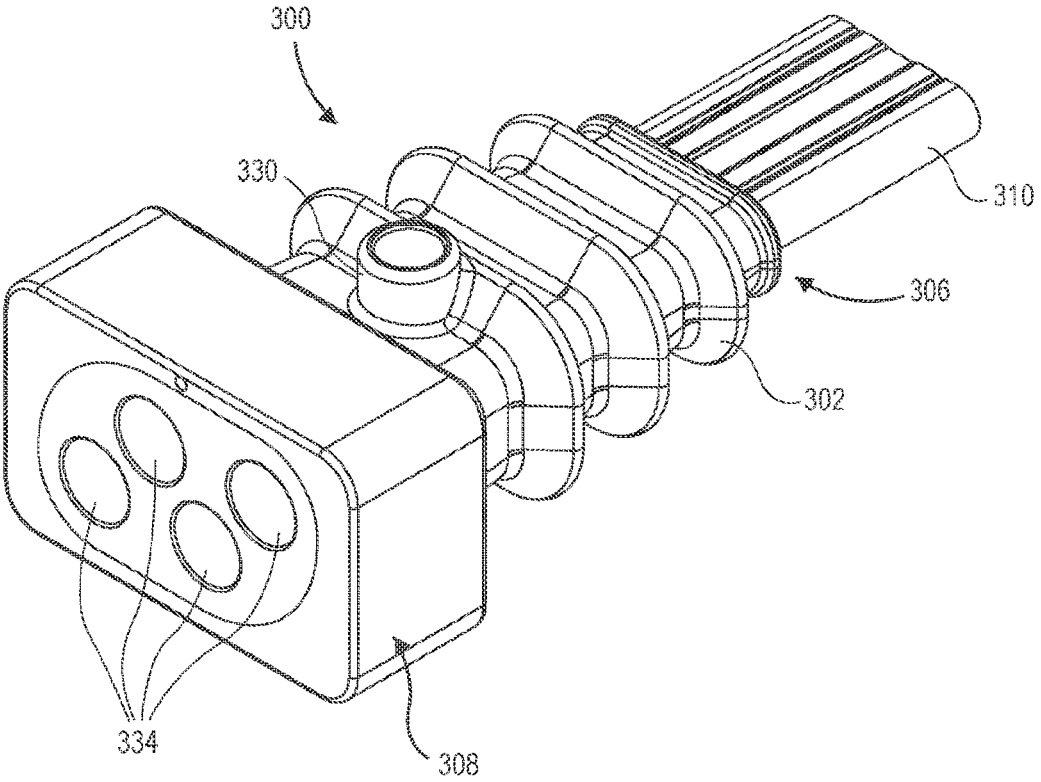
FIG. 9 is a perspective view of an exemplary one-piece multistrand post-tensioning anchor in accordance with various aspects of the disclosure.
Figure 10:
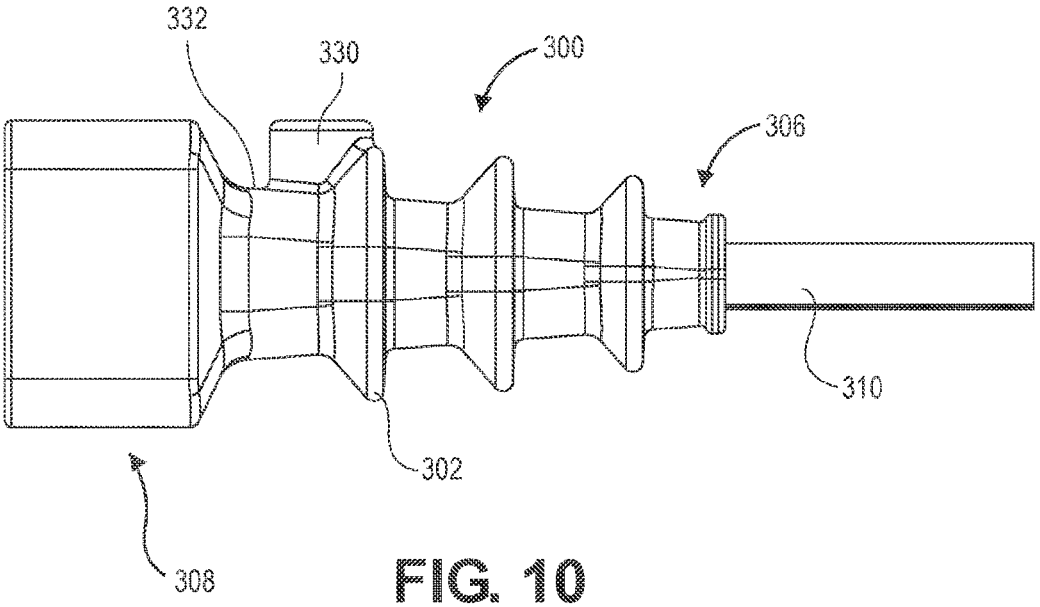
FIG. 10 is a side view of the post-tensioning anchor of FIG. 9.

FIGS. 9 and 10 illustrate an exemplary one-piece multistrand post-tensioning anchor 300 in accordance with various aspects of the disclosure. The anchor 300 is similar to the anchors 100, 200 described above, but includes some variations as described below. The anchor 300 includes a force transfer unit 302 and a steel member 335 configured to resist the clamping force. The force transfer unit 302 is made of any structural concrete including, but not limited to, conventional concrete, fiber reinforced concrete, self-compacting concrete, shrinkage-reducing concrete, or any combination thereof. In some embodiments, the concrete is high strength concrete such as, but not limited to, HPC or UHPC.

The force transfer unit 302 has a first end 306 and an opposite second end 308. The first end 306 is configured to receive at least one connection fitting 310 or a duct, for example, an adaptor piece, a thin plastic sleeve, a sheet metal pipe, a steel duct, or a plastic duct. The steel member is in the force transfer unit 302 proximate the second end 308. The force transfer unit 302 may include a port 330 in an outer wall 332. The port 330 is configured to receive a grout tube (not shown) that is configured to direct grout into the through bore and duct 310.

The anchor 300 defines a through bore (not shown) configured to receive a plurality of tension steel elements from either end of the anchor 300. The second end 308 of the force transfer unit 302 includes a plurality of bores 334, each configured to receive one of the plurality of tension steel elements fed through the through bore in the anchor 300. Each of the plurality of bores 334 at the second end 308 of the force transfer unit 302 is configured to receive one or more wedge pieces similar to the wedge pieces 122, 222 described above. The one or more wedge pieces are configured to cooperate with a tapered inner wall of a respective bore 334 at the second end 308 of the force transfer unit 302 such that a tensile force of the tension steel elements is introduced into the one or more wedge pieces, which are pressed axially into the tapered inner wall of a respective bore 334 and introduce the tensile force via their outer surface into the anchor 300.

Figure 11:
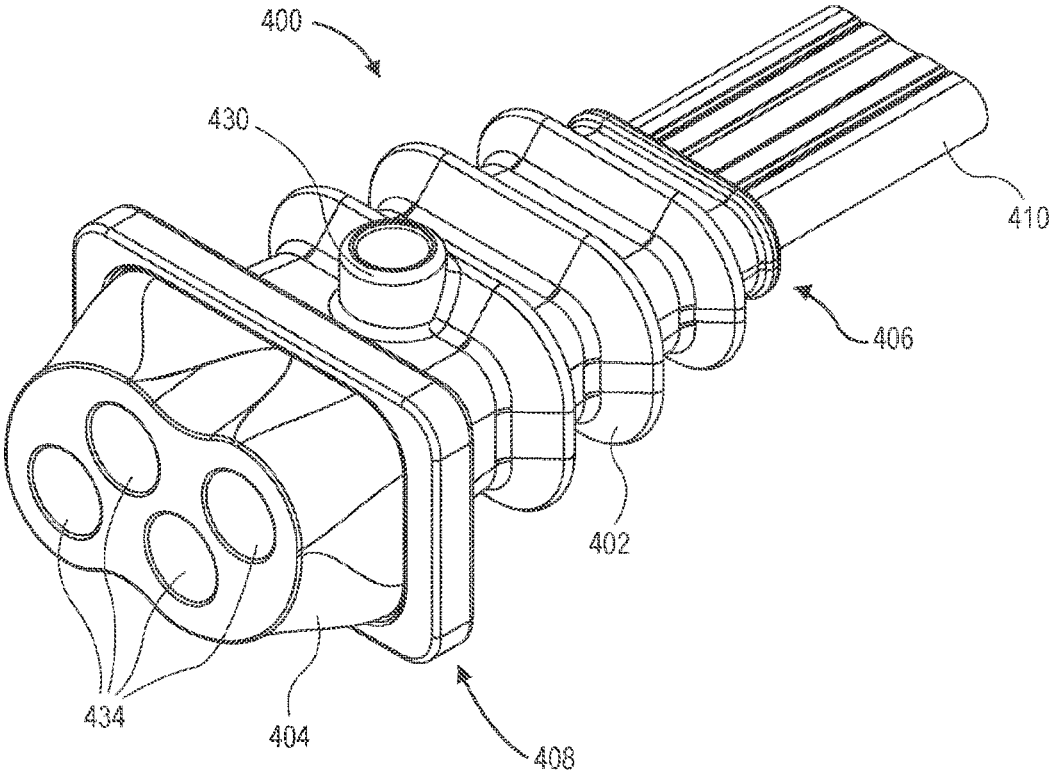
FIG. 11 is a perspective view of an exemplary two-piece multistrand post-tensioning anchor in accordance with various aspects of the disclosure.
Figure 12:
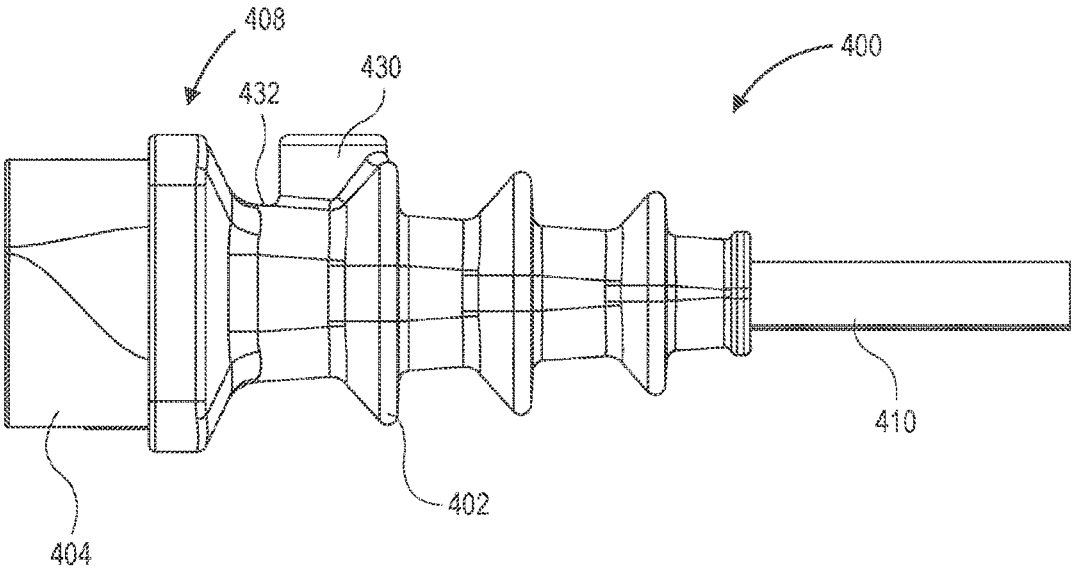
FIG. 12 is a side view of the post-tensioning anchor of FIG. 11.

FIGS. 11 and 12 illustrate an exemplary two-piece multistrand post-tensioning anchor 400 in accordance with various aspects of the disclosure. The anchor 400 is similar to the anchors 100, 200, 300 described above, but includes some variations as described below. The anchor 400 includes a force transfer unit 402 and an anchor head 404 configured to resist the clamping force. The force transfer unit 402 is made of any structural concrete including, but not limited to, conventional concrete, fiber reinforced concrete, self-compacting concrete, shrinkage-reducing concrete, or any combination thereof. In some embodiments, the concrete is high strength concrete such as, but not limited to, HPC or UHPC. The anchor head 404 is made of steel or iron casting.

The force transfer unit 402 has a first end 406 and an opposite second end 408. The first end 406 is configured to receive at least one connection fitting 410, for example, an adaptor piece, a thin plastic sleeve, a sheet metal pipe, a steel duct, a plastic duct, or any conduit. The anchor head 404 is disposed at the second end 408 of the force transfer unit 402.

The anchor 400 defines a through bore (not shown) or a plurality of through bores (not shown) configured to receive a plurality of tension steel elements. The force transfer unit 402 may include a port 430 in an outer wall 432. The port 430 is configured to receive a grout tube (not shown) that is configured to direct grout into the through bore and the connection fitting 410.

The anchor head 404 includes a plurality of bores 434, each configured to receive one of the plurality of tension steel elements fed through the through bore in the force transfer unit 402 from either end of the anchor 400. The bores 434 in the anchor head 404 are configured to receive one or more wedge pieces similar to the wedge pieces 122, 222 described above. The one or more wedge pieces are configured to cooperate with a tapered inner wall of a respective bore 434 in the anchor head 404 such that a tensile force of the tension steel elements is introduced into the one or more wedge pieces, which are pressed axially into the tapered inner wall of a respective bore 434 and introduce the tensile force via their outer surface into the anchor head 404.

Figure 13:
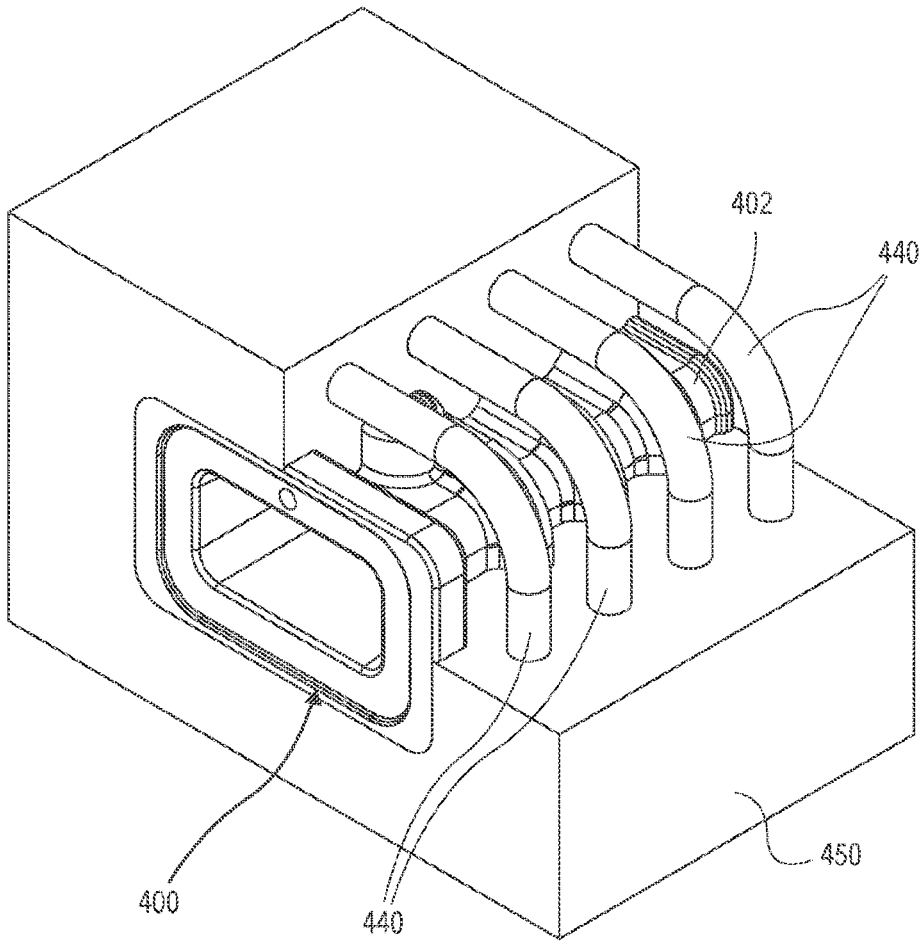
FIG. 13 is a perspective view of the force transfer unit of the post-tensioning anchor of FIG. 11 with a schematic representation of reinforcement in a concrete substrate at the anchor location.

The high strength concrete force transfer unit 402 may not require any steel member and may not need to be coated or encapsulated to provide protection against corrosion. In some construction applications, the anchor 400 can be deployed without reinforcement in the surrounding concrete substrate. In other applications, the anchor 400 can be deployed with reinforcement 440 (i.e., steel reinforcement) in the surrounding concrete substrate 450, as shown in FIG. 13.

Figure 14:
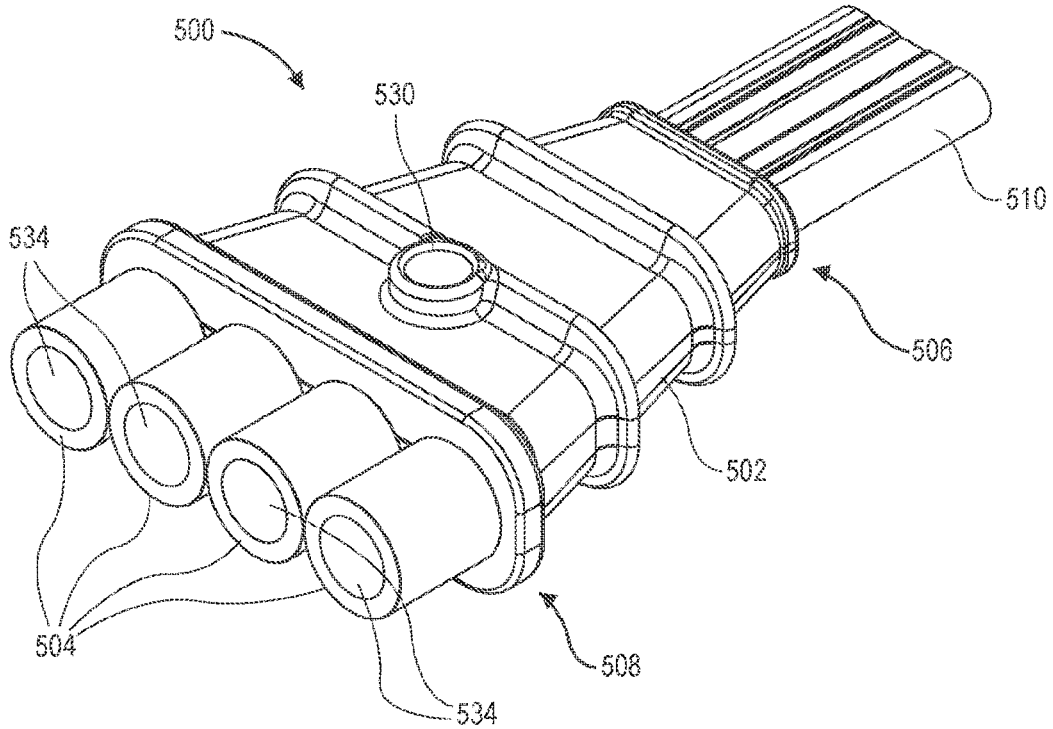
FIG. 14 is a perspective view of an exemplary multi-piece multistrand post-tensioning anchor in accordance with various aspects of the disclosure.
Figure 15:
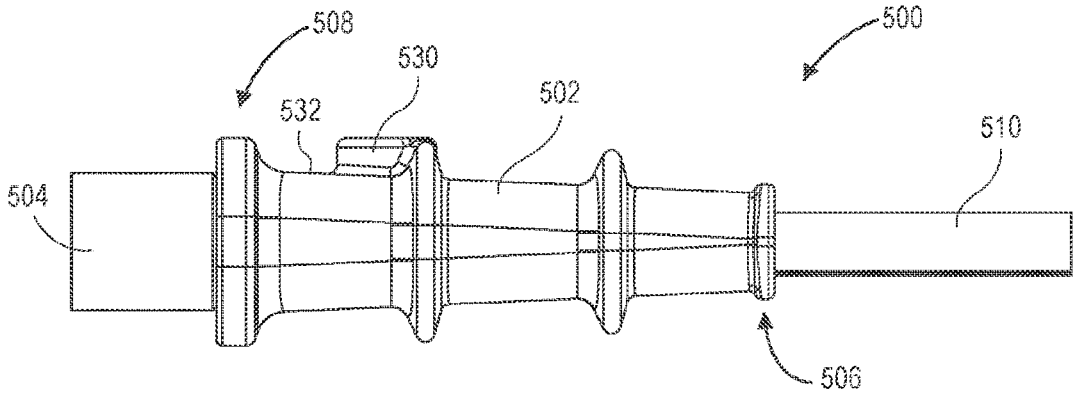
FIG. 15 is a side view of the post-tensioning anchor of FIG. 14.
Figure 16:
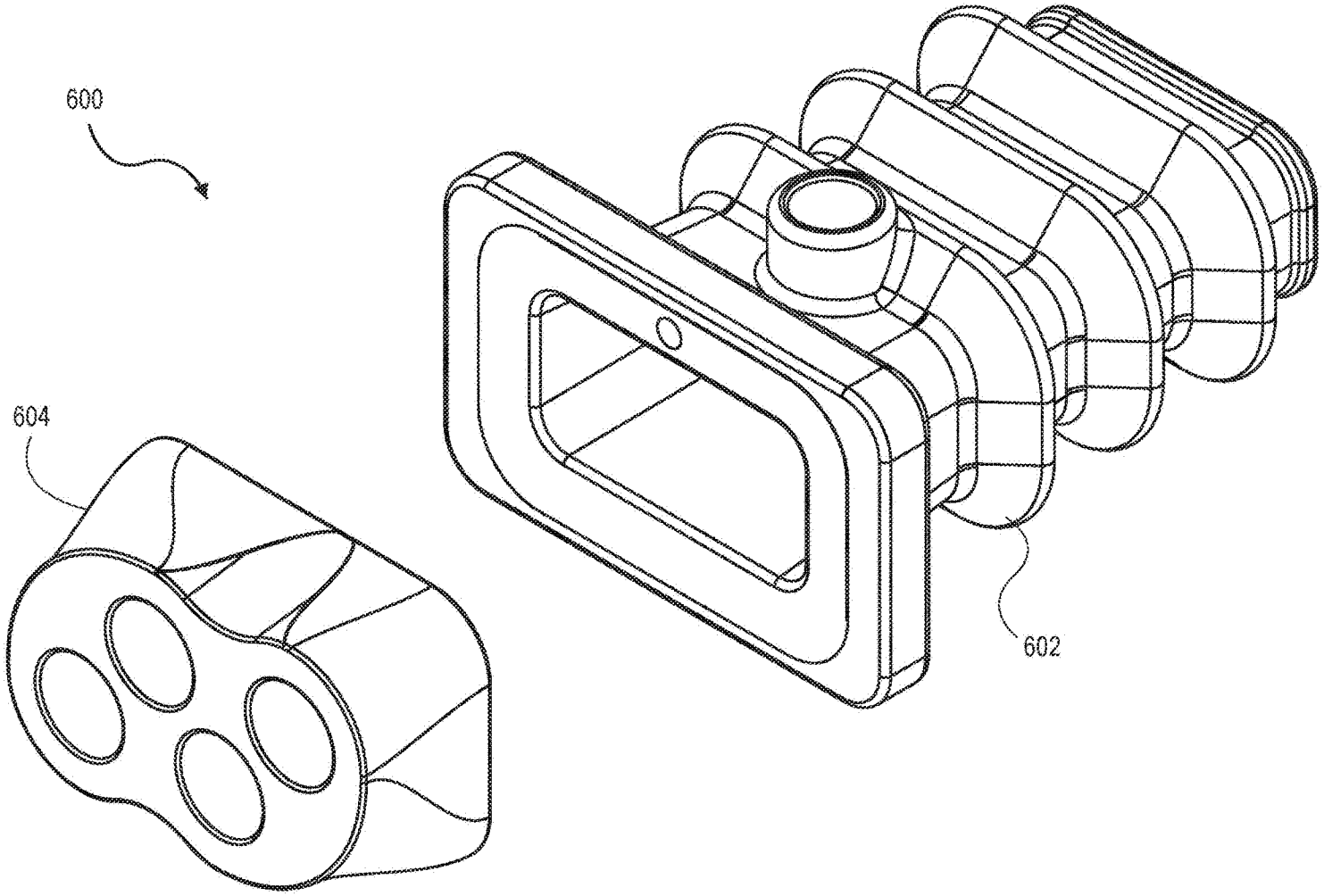
FIG. 16 PRIOR ART
FIG. 16 is a perspective view of a conventional multi-piece multistrand post-tensioning anchor.
Figure 17:
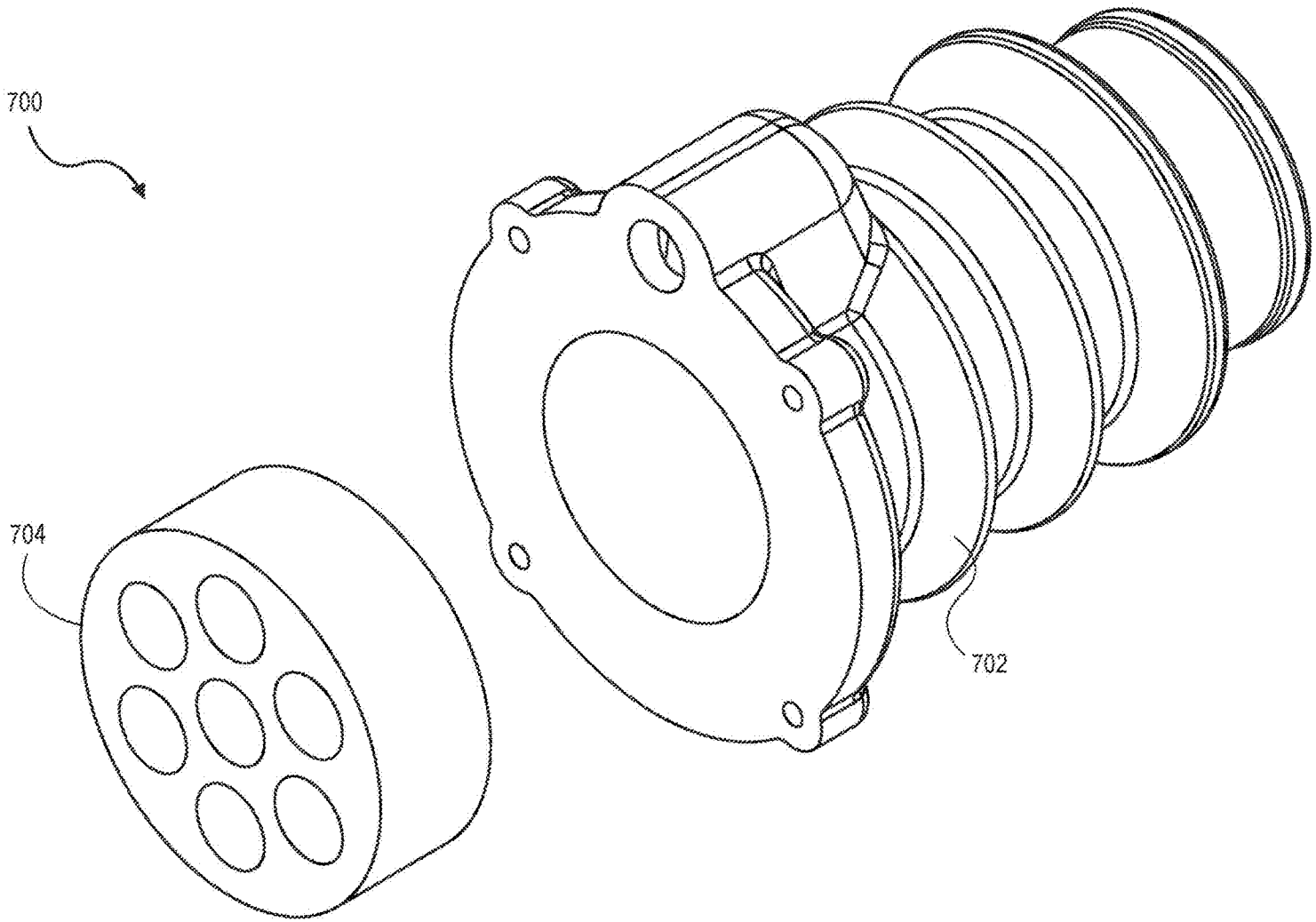
FIG. 17 PRIOR ART
FIG. 17 is a perspective view of another conventional multi-piece multistrand post-tensioning anchor.
Figure 18:
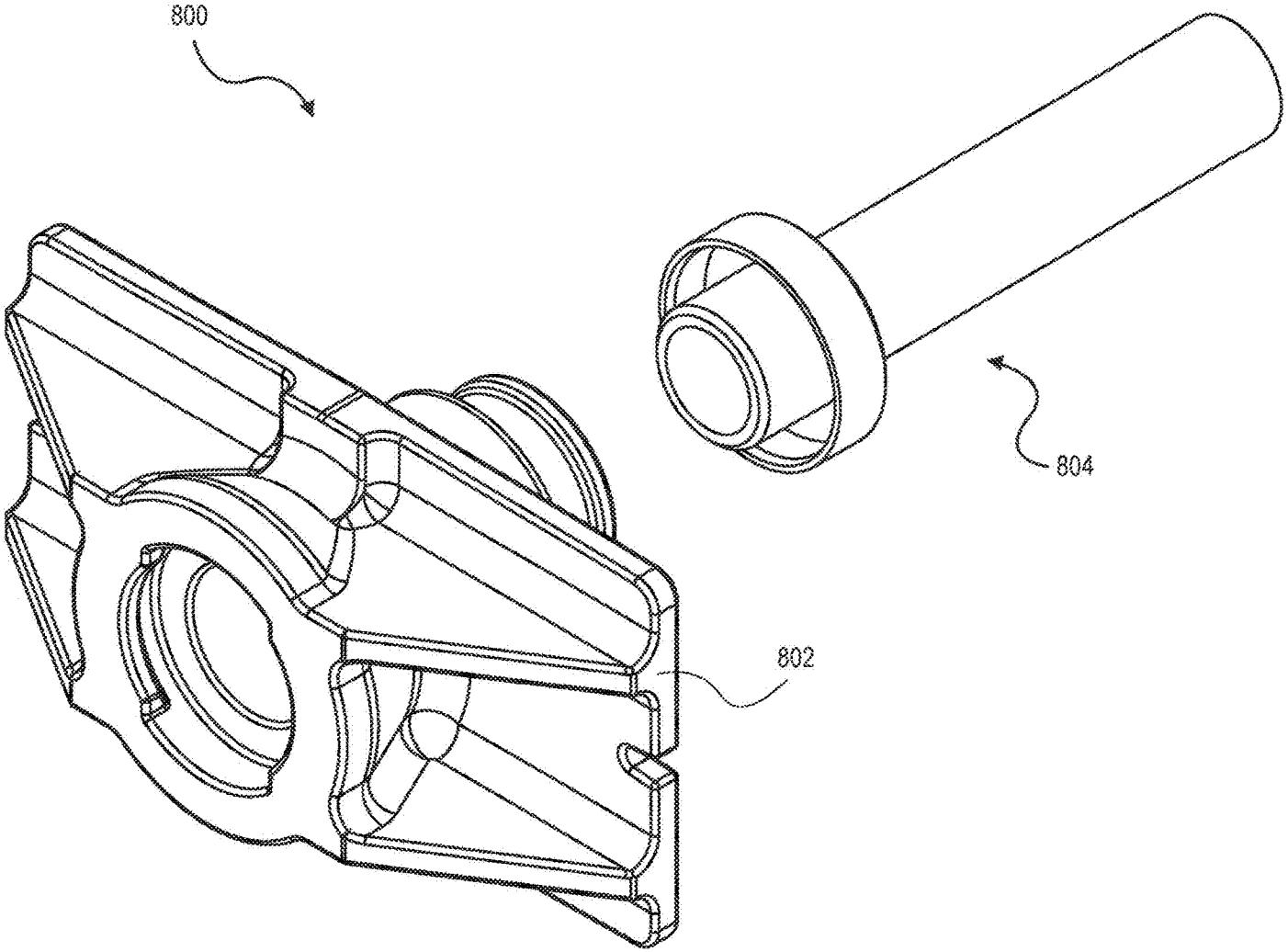
FIG. 18 PRIOR ART
FIG. 18 is a perspective view of a conventional one-piece monostrand post-tensioning anchor.

FIGS. 14 and 15 illustrate an exemplary multi-piece multistrand post-tensioning anchor 500 in accordance with various aspects of the disclosure. The anchor 500 is similar to the anchors 100, 200, 300, 400 described above, but includes some variations as described below. The anchor 500 includes a force transfer unit 502 and a plurality of anchor heads or barrels 504 configured to resist the clamping force. The force transfer unit 502 is made of any structural concrete including, but not limited to, conventional concrete, fiber reinforced concrete, self-compacting concrete, shrinkage-reducing concrete, or any combination thereof. In some embodiments, the concrete is high strength concrete such as, but not limited to, HPC or UHPC. The anchor heads or barrels 504 are made of steel or iron casting.

The force transfer unit 502 has a first end 506 and an opposite second end 508. The first end 506 is configured to receive at least one connection fitting 510, for example, an adaptor piece, a thin plastic sleeve, a sheet metal pipe, a steel duct, or a plastic duct. The anchor barrels 504 are disposed at the second end 508 of the force transfer unit 502.

The anchor 500 defines a through bore (not shown) or a plurality of through bores (not shown) configured to receive a plurality of tension steel elements. The force transfer unit 502 may include a port 530 in an outer wall 532. The port 530 is configured to receive a grout tube (not shown) that is configured to direct grout into the through bore and duct 510.

Each of the anchor barrels 504 includes a respective bore 534 configured to receive one of the plurality of tension steel elements fed through the through bore in the force transfer unit 502 from either end of the anchor 500. The bores 534 in the anchor barrels 504 are configured to receive one or more wedge pieces similar to the wedge pieces 122, 222 described above. The one or more wedge pieces are configured to cooperate with a tapered inner wall of a respective bore 534 in the anchor barrels 504 such that a tensile force of the tension steel elements is introduced into the one or more wedge pieces, which are pressed axially into the tapered inner wall of a respective bore 534 and introduce the tensile force via their outer surface into the anchor head 504.

The high strength concrete force transfer unit 502 may not require any steel member and may not need to be coated or encapsulated to provide protection against corrosion. In some construction applications, and/or structural applications, and/or geotechnical applications, the anchor 500 can be deployed in bonded or unbonded post-tensioned concrete without reinforcement in the surrounding concrete substrate. In other applications, the anchor 500 can be deployed in bonded or unbonded post-tensioned concrete with reinforcement in the surrounding concrete substrate, similar to that shown in FIG. 13. Likewise, anchors 100, 200, 300 can be deployed without reinforcement in the surrounding concrete or with reinforcement in the surrounding concrete substrate.

Additional embodiments include any one of the embodiments described above, where one or more of its components, functionalities, or structures is interchanged with, replaced by or augmented by one or more of the components, functionalities, or structures of a different embodiment described above.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

What is claimed is:

1. An anchoring assembly configured to post-tension at least one tension steel element, the anchoring assembly comprising:

a post-tensioning anchor comprising:

a force transfer unit comprising a first end, a second end, and a bore extending therethrough, wherein the bore comprises a second end bore portion proximate to the second end, wherein the second end bore portion has a diameter that increases proceeding toward the second end, wherein the force transfer unit is configured to transmit a prestressing force into a surrounding concrete substrate, and wherein the force transfer unit is made of concrete; and at least one steel member positioned proximate to the force transfer unit;

a connection fitting positioned at least partially in the bore and proximate to the first end, wherein the connection fitting is between the at least one tension steel element and the force transfer unit; and at least one wedge piece positioned at least partially in the bore and proximate to the second end, wherein the at least one steel member is outward from the at least one wedge piece, wherein the at least one wedge piece cooperates with the second end bore portion such that a post-tensioning force of the at least one tension steel element is introduced into the at least one wedge piece, which is pressed axially into the second end bore portion and introduces the post-tensioning force into the post-tensioning anchor, and wherein the at least one steel member is configured to partially resist the post tensioning force at the at least one wedge piece.

2. The anchoring assembly of claim 1, wherein the first end is configured to receive the at least one tension steel element, wherein the force transfer unit is configured to permit the at least one tension steel element to extend through the force transfer unit, and wherein the second end is configured to receive the at least one wedge to clamp the force transfer unit with the at least one tension steel element.

3. The anchoring assembly of claim 2, wherein the at least one steel member is at the second end of the force transfer unit.

4. The anchoring assembly of claim 3, wherein the at least one steel member is embedded in the force transfer unit.

5. The anchoring assembly of claim 3, wherein the at least one steel member is a steel conduit.

6. The anchoring assembly of claim 5, wherein the steel conduit is a steel barrel or a steel channel.

7. The anchoring assembly of claim 3, wherein the at least one steel member is a steel spiral or a series of steel links.

8. The anchoring assembly of claim 2, wherein the at least one steel member is a plurality of steel conduits and/or steel spirals and/or steel links placed anywhere between the first end and the second end.

9. The anchoring assembly of claim 2, wherein the plurality of steel conduits and/or steel spirals and/or steel links are located at at least two different locations between the first end and the second end.

10. The anchoring assembly of claim 2, wherein the force transfer unit is configured to receive a plurality of the at least one tension steel element, and the second end of the force transfer unit includes one bore or a number of bores corresponding to or greater than a number of the plurality of the at least one tension steel element.

11. The anchoring assembly of claim 1, wherein the force transfer unit is made of a concrete that contains but not limited to organic, basalt, bare steel, or coated steel fibers.

12. The anchoring assembly of claim 1, wherein the at least one steel member is a plurality of steel conduits and/or steel spirals and/or steel links.

13. The anchoring assembly of claim 1, wherein the at least one steel member is coated with a material configured to protect the steel member from corrosion.

14. The anchoring assembly of claim 1, wherein the force transfer unit is configured to receive a plurality of the at least one tension steel element, and the anchor head includes a number of bores corresponding to or greater than a number of the plurality of the at least one tension steel element.

15. The anchoring assembly of claim 1, wherein the concrete has a minimum compressive strength of at least 10,000 psi.

16. The anchoring assembly of claim 1, wherein the concrete has a minimum compressive strength of 15,000 to 50,000 psi.

17. The anchoring assembly of claim 1, wherein the concrete has a tensile strength larger than 400 psi.

18. The anchoring assembly of claim 1, wherein the wedge piece presses radially into the at least one steel member.

19. The anchoring assembly of claim 1, wherein the wedge piece does not press radially into the force transfer unit.

20. The anchoring assembly of claim 1, wherein the at least one steel member is in the force transfer unit.

* * * * *